US011326627B2

(12) United States Patent
Rannow et al.

(10) Patent No.: US 11,326,627 B2
(45) Date of Patent: May 10, 2022

(54) CONTROL METHOD AND SYSTEM FOR USING A PAIR OF INDEPENDENT HYDRAULIC METERING VALVES TO REDUCE BOOM OSCILLATIONS

(71) Applicant: DANFOSS POWER SOLUTIONS II TECHNOLOGY A/S, Nordborg (DK)

(72) Inventors: Michael Berne Rannow, Eden Prairie, MN (US); Meng Wang, Eden Prairie, MN (US)

(73) Assignee: DANFOSS POWER SOLUTIONS II TECHNOLOGY A/S, Nordborg (DK)

( * ) Notice: Subject to any disclaimer, the term of this patent is extended or adjusted under 35 U.S.C. 154(b) by 0 days.

(21) Appl. No.: 16/938,221

(22) Filed: Jul. 24, 2020

(65) Prior Publication Data

US 2021/0010490 A1 Jan. 14, 2021

Related U.S. Application Data

(63) Continuation of application No. 16/047,630, filed on Jul. 27, 2018, now Pat. No. 10,724,552, which is a (Continued)

(51) Int. Cl.
*F15B 11/00* (2006.01)
*E02F 9/22* (2006.01)
(Continued)

(52) U.S. Cl.
CPC ..... *F15B 11/003* (2013.01); *B66C 13/066* (2013.01); *E02F 9/226* (2013.01); (Continued)

(58) Field of Classification Search
CPC .. F15B 11/003; F15B 11/0445; F15B 21/008; F15B 2211/6306; F15B 2211/6313; F15B 2211/8613; B66C 13/066; E04G 21/0454
See application file for complete search history.

(56) References Cited

U.S. PATENT DOCUMENTS 3,917,246 A 11/1975 Gartner et al.
4,621,375 A 11/1986 Simnovec
(Continued)

FOREIGN PATENT DOCUMENTS

CN 201670158 U 12/2010
CN 202322251 U 7/2012
(Continued)

OTHER PUBLICATIONS

Extended European Search Report for Application No. 14803575.1 dated Dec. 20, 2016.
(Continued)

*Primary Examiner* — Thomas E Lazo

(57) ABSTRACT

A hydraulic system (600) and method for reducing boom dynamics of a boom (30), while providing counter-balance valve protection, includes a hydraulic cylinder (110), first and second counter-balance valves (300, 400), and first and second control valves (700, 800). A net load (90) is supported by a first chamber (116, 118) of the hydraulic cylinder, and a second chamber (118, 116) of the hydraulic cylinder may receive fluctuating hydraulic fluid flow from the second control valve to produce a vibratory response (950) that counters environmental vibrations (960) on the boom. The first control valve may apply a holding pressure and thereby hold the first counter-balance valve closed and the second counter-balance valve open.

17 Claims, 6 Drawing Sheets

Related U.S. Application Data continuation of application No. 14/915,449, filed as application No. PCT/US2014/053523 on Aug. 29, 2014, now Pat. No. 10,036,407.

(60) Provisional application No. 61/872,424, filed on Aug. 30, 2013.

(51) Int. Cl.
*B66C 13/06* (2006.01)
*E04G 21/04* (2006.01)
*F15B 11/044* (2006.01)

(52) U.S. Cl.
CPC ..... *E02F 9/2207* (2013.01); *E04G 21/0436* (2013.01); *E04G 21/0454* (2013.01); *F15B 11/0445* (2013.01); *F15B 2211/3057* (2013.01); *F15B 2211/5059* (2013.01); *F15B 2211/6306* (2013.01); *F15B 2211/6313* (2013.01); *F15B 2211/6336* (2013.01); *F15B 2211/6343* (2013.01); *F15B 2211/6346* (2013.01); *F15B 2211/6658* (2013.01); *F15B 2211/8613* (2013.01)

(56) References Cited

U.S. PATENT DOCUMENTS

| | | | |
|---|---|---|---|
| 4,896,582 | A | 1/1990 | Tordenmalm et al. |
| 5,048,296 | A | 9/1991 | Sunamura et al. |
| 5,191,826 | A | 3/1993 | Brunner |
| 5,230,272 | A | 7/1993 | Schmitz |
| 5,245,826 | A | 9/1993 | Roth et al. |
| 5,571,226 | A | 11/1996 | Kobayashi |
| 5,640,996 | A | 6/1997 | Schlecht et al. |
| 5,699,386 | A | 12/1997 | Measor et al. |
| 5,715,865 | A | 2/1998 | Wilke |
| 5,784,944 | A | 7/1998 | Tozawa et al. |
| 5,832,730 | A | 11/1998 | Mizui |
| 5,996,465 | A | 12/1999 | Morikawa et al. |
| 6,202,013 | B1 | 3/2001 | Anderson et al. |
| 6,328,173 | B1 | 12/2001 | Wimmer |
| 6,634,172 | B2 | 10/2003 | Schoonmaker et al. |
| 6,883,532 | B2 | 4/2005 | Rau |
| 7,143,682 | B2 | 12/2006 | Nissing et al. |
| 7,269,947 | B2 | 9/2007 | Yoshino |
| 7,278,262 | B2 | 10/2007 | Moon |
| 7,296,404 | B2 | 11/2007 | Pfaff |
| 7,729,832 | B2 | 6/2010 | Benckert et al. |
| 7,845,169 | B2 | 12/2010 | Brickner et al. |
| 8,037,682 | B2 | 10/2011 | Yi et al. |
| 8,082,083 | B2 | 12/2011 | Pirri et al. |
| 8,925,310 | B2 | 1/2015 | Pirri et al. |
| 9,810,242 | B2 | 11/2017 | Wang |
| 9,933,328 | B2 | 4/2018 | Rannow |
| 10,036,407 | B2 | 7/2018 | Rannow et al. |
| 10,316,929 | B2 | 6/2019 | Wang et al. |
| 10,323,663 | B2 | 6/2019 | Wang et al. |
| 10,344,783 | B2 | 7/2019 | Wang et al. |
| 10,502,239 | B2 | 12/2019 | Wang et al. |
| 10,605,277 | B2 | 3/2020 | Wang et al. |
| 10,724,552 | B2 | 7/2020 | Wang et al. |
| 11,028,861 | B2 | 6/2021 | Wang |
| 11,047,406 | B2 | 6/2021 | Wang et al. |
| 2002/0092417 | A1 | 7/2002 | Suzuki et al. |
| 2003/0159576 | A1 | 8/2003 | Schoonmaker et al. |
| 2006/0272325 | A1 | 12/2006 | Moon |
| 2007/0299589 | A1 | 12/2007 | Gianoglio et al. |
| 2008/0034957 | A1 | 2/2008 | Stephenson et al. |
| 2008/0087163 | A1 | 4/2008 | Brickner et al. |
| 2010/0095835 | A1* | 4/2010 | Yuan ..... B66C 13/066 91/392 |
| 2010/0186401 | A1 | 7/2010 | Kauss et al. |
| 2011/0088785 | A1 | 4/2011 | Balasubramania |
| 2011/0179783 | A1 | 7/2011 | Pirri et al. |
| 2012/0198832 | A1 | 8/2012 | Fukumoto |
| 2014/0026548 | A1 | 1/2014 | Vigholm et al. |
| 2014/0150416 | A1 | 6/2014 | Lee |
| 2016/0108936 | A1 | 4/2016 | Wang |
| 2016/0222989 | A1 | 8/2016 | Rannow et al. |
| 2016/0298660 | A1 | 10/2016 | Wang et al. |
| 2016/0298719 | A1 | 10/2016 | Wang et al. |
| 2017/0204886 | A1 | 7/2017 | Wang et al. |
| 2018/0156243 | A1 | 6/2018 | Wang |
| 2019/0101137 | A1 | 4/2019 | Rannow et al. |
| 2020/0003239 | A1 | 1/2020 | Wang et al. |
| 2020/0032820 | A1 | 1/2020 | Wang et al. |
| 2020/0124061 | A1 | 4/2020 | Yuan |
| 2020/0124062 | A1 | 4/2020 | Yuan |
| 2020/0248720 | A1 | 8/2020 | Wang et al. |

FOREIGN PATENT DOCUMENTS

| | | | |
|---|---|---|---|
| CN | 102705288 | A | 10/2012 |
| DE | 102 53 871 | B3 | 8/2004 |
| DE | 20 2009 007 668 | U1 | 10/2009 |
| EP | 0 457 913 | A1 | 11/1991 |
| EP | 1 134 431 | B1 | 5/2005 |
| EP | 2 347 988 | A1 | 7/2011 |
| EP | 2 503 161 | A2 | 9/2012 |
| JP | H05-163746 | A | 6/1993 |
| JP | 6-147259 | A | 5/1994 |
| JP | 7-113436 | A | 5/1995 |
| JP | 7-300881 | A | 11/1995 |
| JP | 9-041428 | A | 2/1997 |
| JP | 3079498 | B2 | 8/2000 |
| JP | 2003-20197 | A | 1/2003 |
| JP | 2004-301214 | A | 10/2004 |
| JP | 2004-308746 | A | 11/2004 |
| JP | 2006-300280 | A | 11/2006 |
| JP | 2009-74692 | A | 4/2009 |
| JP | 2012-197937 | A | 10/2012 |
| JP | 2013-35527 | A | 2/2013 |
| KR | 10-2003-0088425 | A | 11/2003 |
| KR | 10-1190553 | B1 | 10/2012 |
| WO | 2014/165888 | A1 | 10/2014 |
| WO | 2014/193649 | A1 | 12/2014 |
| WO | 2015/073329 | A1 | 5/2015 |
| WO | 2015/073330 | A1 | 5/2015 |
| WO | 2015/191661 | A1 | 12/2015 |
| WO | 2016/011193 | A1 | 1/2016 |

OTHER PUBLICATIONS

Extended European Search Report for corresponding European Patent Application No. 14840792.7 dated May 9, 2017, 5 pages.
Extended European Search Report for Application No. 14862808.4 dated May 17, 2017.
Extended European Search Report for Application No. 14861695.6 dated Jun. 23, 2017.
Extended European Search Report for corresponding European Patent Application No. 15822402.2 dated Mar. 6, 2018, 8 pages.
Honma, K. et al., "Vibration Damping Control for Construction Machinery with a Long Arm Manipulator," Journal of the Robotics Society of Japan (JRSJ), vol. 6, No. 5, pp. 99-102 (Oct. 1988).
International Search Report for corresponding International Patent Application No. PCT/US2014/037879 dated Sep. 22, 2014.
International Search Report for corresponding International Patent Application No. PCT/US2014/053523 dated Dec. 3, 2014.
International Search Report for corresponding International Patent Application No. PCT/US2014/064646 dated Mar. 12, 2015.
International Search Report for corresponding International Patent Application No. PCT/US2014/064651 dated Feb. 16, 2015.
International Search Report for corresponding International Patent Application No. PCT/US2014/040636 dated Oct. 15, 2015.
International Search Report and Written Opinion of the International Searching Authority for corresponding International Patent Application No. PCT/US2015/040636 dated Oct. 15, 2015, 8 pgs.
Ultronics ZTS16 Control Architecture Overview, Version 1.3, 18 pages (Jul. 2010).
Ultronics ZTS16 User Manual V1.0 (for SW Version 2.3 & OD

(56) References Cited

OTHER PUBLICATIONS

Version 2.2, 52 pages (Nov. 25, 2009).
Extended European Search Report for Application No. 17891854.5 dated Jan. 14, 2021.
International Search Report and Written Opinion of the International Searching Authority for International Patent Application No. PCT/US2018/029384 dated Aug. 9, 2018, 15 pages.
Extended European Search Report for Application No. 18792266.1 dated Jan. 14, 2021.
International Search Report and Written Opinion of the International Searching Authority for International Patent Application No. PCT/US2018/029401 dated Jul. 23, 2018, 18 pages.

* cited by examiner

CONTROL METHOD AND SYSTEM FOR USING A PAIR OF INDEPENDENT HYDRAULIC METERING VALVES TO REDUCE BOOM OSCILLATIONS

CROSS-REFERENCE TO RELATED APPLICATION(S)

This application is a Continuation of U.S. patent application Ser. No. 16/047,630, filed on Jul. 27, 2018, now U.S. Pat. No. 10,724,552, which is a Continuation of U.S. patent application Ser. No. 14/915,449, filed on Feb. 29, 2016, now U.S. Pat. No. 10,036,407, which is a National Stage of PCT/US2014/053523, filed on Aug. 29, 2014, which claims benefit of U.S. Patent Application Ser. No. 61/872,424 filed on Aug. 30, 2013, and which applications are incorporated herein by reference. To the extent appropriate, a claim of priority is made to each of the above disclosed applications.

BACKGROUND

Various off-road and on-road vehicles include booms. For example, certain concrete pump trucks include a boom configured to support a passage through which concrete is pumped from a base of the concrete pump truck to a location at a construction site where the concrete is needed. Such booms may be long and slender to facilitate pumping the concrete a substantial distance away from the concrete pump truck. In addition, such booms may be relatively heavy. The combination of the substantial length and mass properties of the boom may lead to the boom exhibiting undesirable dynamic behavior. In certain booms in certain configurations, a natural frequency of the boom may be about 0.3 Hertz (i.e., 3.3 seconds per cycle). In certain booms in certain configurations, the natural frequency of the boom may be less than about 1 Hertz (i.e., 1 second per cycle). In certain booms in certain configurations, the natural frequency of the boom may range from about 0.1 Hertz to about 1 Hertz (i.e., 10 seconds per cycle to 1 second per cycle). For example, as the boom is moved from place to place, the starting and stopping loads that actuate the boom may induce vibration (i.e., oscillation). Other load sources that may excite the boom include momentum of the concrete as it is pumped along the boom, starting and stopping the pumping of concrete along the boom, wind loads that may develop against the boom, and/or other miscellaneous loads.

Other vehicles with booms include fire trucks in which a ladder may be included on the boom, fire trucks which include a boom with plumbing to deliver water to a desired location, excavators which use a boom to move a shovel, tele-handlers which use a boom to deliver materials around a construction site, cranes which may use a boom to move material from place to place, etc.

In certain boom applications, including those mentioned above, a hydraulic cylinder may be used to actuate the boom. By actuating the hydraulic cylinder, the boom may be deployed and retracted, as desired, to achieve a desired placement of the boom. In certain applications, counter-balance valves may be used to control actuation of the hydraulic cylinder and/or to prevent the hydraulic cylinder from uncommanded movement (e.g., caused by a component failure). A prior art system 100, including a first counter-balance valve 300 and a second counter-balance valve 400 is illustrated at FIG. 1. The counter-balance valve 300 controls and/or transfers hydraulic fluid flow into and out of a first chamber 116 of a hydraulic cylinder 110 of the system 100. Likewise, the second counter-balance valve 400 controls and/or transfers hydraulic fluid flow into and out of a second chamber 118 of the hydraulic cylinder 110. In particular, a port 302 of the counter-balance valve 300 is connected to a port 122 of the hydraulic cylinder 110. Likewise, a port 402 of the counter-balance valve 400 is fluidly connected to a port 124 of the hydraulic cylinder 110. As depicted, a fluid line 522 schematically connects the port 302 to the port 122, and a fluid line 524 connects the port 402 to the port 124. The counter-balance valves 300, 400 are typically mounted directly to the hydraulic cylinder 110. The port 302 may directly connect to the port 122, and the port 402 may directly connect to the port 124.

The counter-balance valves 300, 400 provide safety protection to the system 100. In particular, before movement of the cylinder 110 can occur, hydraulic pressure must be applied to both of the counter-balance valves 300, 400. The hydraulic pressure applied to one of the counter-balance valves 300, 400 is delivered to a corresponding one of the ports 122, 124 of the hydraulic cylinder 110 thereby urging a piston 120 of the hydraulic cylinder 110 to move. The hydraulic pressure applied to an opposite one of the counter-balance valves 400, 300 allows hydraulic fluid to flow out of the opposite port 124, 122 of the hydraulic cylinder 110. By requiring hydraulic pressure at the counter-balance valve 300, 400 corresponding to the port 122, 124 that is releasing the hydraulic fluid, a failure of a hydraulic line, a valve, a pump, etc. that supplies or receives the hydraulic fluid from the hydraulic cylinder 110 will not result in uncommanded movement of the hydraulic cylinder 110.

Turning now to FIG. 1, the system 100 will be described in detail. As depicted, a four-way three position hydraulic control valve 200 is used to control the hydraulic cylinder 110. The control valve 200 includes a spool 220 that may be positioned at a first configuration 222, a second configuration 224, or a third configuration 226. As depicted at FIG. 1, the spool 220 is at the first configuration 222. In the first configuration 222, hydraulic fluid from a supply line 502 is transferred from a port 212 of the control valve 200 to a port 202 of the control valve 200 and ultimately to the port 122 and the chamber 116 of the hydraulic cylinder 110. The hydraulic cylinder 110 is thereby urged to extend and hydraulic fluid in the chamber 118 of the hydraulic cylinder 110 is urged out of the port 124 of the cylinder 110. Hydraulic fluid leaving the port 124 returns to a hydraulic tank by entering a port 204 of the control valve 200 and exiting a port 214 of the control valve 200 into a return line 504. In certain embodiments, the supply line 502 supplies hydraulic fluid at a constant or at a near constant supply pressure. In certain embodiments, the return line 504 receives hydraulic fluid at a constant or at a near constant return pressure.

When the spool 220 is positioned at the second configuration 224, hydraulic fluid flow between the port 202 and the port 212 and hydraulic fluid flow between the port 204 and the port 214 is effectively stopped, and hydraulic fluid flow to and from the cylinder 110 is effectively stopped. Thus, the hydraulic cylinder 110 remains substantially stationary when the spool 220 is positioned at the second configuration 224.

When the spool 220 is positioned at the third configuration 226, hydraulic fluid flow from the supply line 502 enters through the port 212 and exits through the port 204 of the valve 200. The hydraulic fluid flow is ultimately delivered to the port 124 and the chamber 118 of the hydraulic cylinder 110 thereby urging retraction of the cylinder 110. As hydraulic fluid pressure is applied to the chamber 118, hydraulic fluid within the chamber 116 is urged to exit through the port 122. Hydraulic fluid exiting the port 122 enters the port 202 and exits the port 214 of the valve 200 and thereby returns to the hydraulic tank. An operator and/or a control system may move the spool 220 as desired and thereby achieve extension, retraction, and/or locking of the hydraulic cylinder 110.

A function of the counter-balance valves 300, 400 when the hydraulic cylinder 110 is extending will now be discussed in detail. Upon the spool 220 of the valve 200 being placed in the first configuration 222, hydraulic fluid pressure from the supply line 502 pressurizes a hydraulic line 512. The hydraulic line 512 is connected between the port 202 of the control valve 200, a port 304 of the counter-balance valve 300, and a port 406 of the counter-balance valve 400. Hydraulic fluid pressure applied at the port 304 of the counter-balance valve 300 flows past a spool 310 of the counter-balance valve 300 and past a check valve 320 of the counter-balance valve 300 and thereby flows from the port 304 to the port 302 through a passage 322 of the counter-balance valve 300. The hydraulic fluid pressure further flows through the port 122 and into the chamber 116 (i.e., a meter-in chamber). Pressure applied to the port 406 of the counter-balance valve 400 moves a spool 410 of the counter-balance valve 400 against a spring 412 and thereby compresses the spring 412. Hydraulic fluid pressure applied at the port 406 thereby opens a passage 424 between the port 402 and the port 404. By applying hydraulic pressure at the port 406, hydraulic fluid may exit the chamber 118 (i.e., a meter-out chamber) through the port 124, through the line 524, through the passage 424 of the counter-balance valve 400 across the spool 410, through a hydraulic line 514, through the valve 200, and through the return line 504 into the tank. The meter-out side may supply backpressure.

A function of the counter-balance valves 300, 400 when the hydraulic cylinder 110 is retracting will now be discussed in detail. Upon the spool 220 of the valve 200 being placed in the third configuration 226, hydraulic fluid pressure from the supply line 502 pressurizes the hydraulic line 514. The hydraulic line 514 is connected between the port 204 of the control valve 200, a port 404 of the counter-balance valve 400, and a port 306 of the counter-balance valve 300. Hydraulic fluid pressure applied at the port 404 of the counter-balance valve 400 flows past the spool 410 of the counter-balance valve 400 and past a check valve 420 of the counter-balance valve 400 and thereby flows from the port 404 to the port 402 through a passage 422 of the counter-balance valve 400. The hydraulic fluid pressure further flows through the port 124 and into the chamber 118 (i.e., a meter-in chamber). Hydraulic pressure applied to the port 306 of the counter-balance valve 300 moves the spool 310 of the counter-balance valve 300 against a spring 312 and thereby compresses the spring 312. Hydraulic fluid pressure applied at the port 306 thereby opens a passage 324 between the port 302 and the port 304. By applying hydraulic pressure at the port 306, hydraulic fluid may exit the chamber 116 (i.e., a meter-out chamber) through the port 122, through the line 522, through the passage 324 of the counter-balance valve 300 across the spool 310, through the hydraulic line 512, through the valve 200, and through the return line 504 into the tank. The meter-out side may supply backpressure.

The supply line 502, the return line 504, the hydraulic line 512, the hydraulic line 514, the hydraulic line 522, and/or the hydraulic line 524 may belong to a line set 500.

Conventional solutions for reducing these oscillations are typically passive (i.e., orifices) which are tuned for one particular operating point and often have a negative impact on efficiency. Many machines/vehicles with extended booms employ counter-balance valves (CBVs) such as counter-balance valves 300, 400 for safety and safety regulation reasons. These counter-balance valves (CBVs) restrict/block the ability of the hydraulic control valve (e.g., the hydraulic control valve 200) to sense and act upon pressure oscillations. In certain applications, such as concrete pump truck booms, oscillations are induced by external sources (e.g., the pumping of the concrete) when the machine (e.g., the boom) is nominally stationary. In this case, the counter-balance valves (CBVs) are closed, and the main control valve (e.g., the hydraulic control valve 200) is isolated from the oscillating pressure that is induced by the oscillations. There are a number of conventional solutions that approach this problem, that typically rely on joint position sensors to sense the oscillations (i.e., ripples) and prevent drift due to flow through a ripple-cancelling valve. Some solutions also have parallel hydraulic systems that allow a ripple-cancelling valve to operate while the counter-balance valves (CBVs) are in place.

SUMMARY

One aspect of the present disclosure relates to systems and methods for reducing boom dynamics (e.g., boom bounce) of a boom while providing counter-balance valve protection to the boom.

Another aspect of the present disclosure relates to a hydraulic system including a hydraulic cylinder, a first counter-balance valve, a second counter-balance valve, a first control valve, and a second control valve. The hydraulic cylinder includes a first chamber and a second chamber. The first counter-balance valve fluidly connects to the first chamber at a first node, and the second counter-balance valve fluidly connects to the second chamber at a second node. The first control valve fluidly connects to the first counter-balance valve and to a pilot of the second counter-balance valve at a third node, and a second control valve fluidly connects to the second counter-balance valve and to a pilot of the first counter-balance valve at a fourth node. When a net load is supported by the first chamber of the hydraulic cylinder and when vibration control is active: 1) a holding pressure is transmitted from the first control valve to the third node to hold the first counter-balance valve at a closed position and to hold the second counter-balance valve at an open position; and 2) a fluctuating pressure is transmitted from the second control valve to the fourth node and through the open second counter-balance valve to the second node. The holding pressure is less than a load pressure at the first node. The fluctuating pressure causes the hydraulic cylinder to produce a vibratory response.

In certain embodiments, the first chamber is a rod chamber and the second chamber is a head chamber. In other embodiments, the first chamber is a head chamber and the second chamber is a rod chamber. In certain embodiments, the first counter-balance valve and the second counter-balance valve are physically mounted to the hydraulic cylinder.

Still another aspect of the present disclosure relates to a method of controlling vibration in a boom. The method includes: 1) providing a hydraulic actuator with a pair of chambers; 2) providing a valve arrangement with a pair of counter-balance valves that correspond to the pair of chambers and also with a pair of control valves that correspond to the pair of chambers; 3) identifying a loaded chamber of the pair of chambers; 4) locking a corresponding one of the pair of counter-balance valves that corresponds to the loaded chamber; and 5) transmitting vibrating hydraulic fluid from a corresponding one of the pair of control valves that corresponds to an unloaded chamber of the pair of chambers.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DETAILED DESCRIPTION

Figure 1:
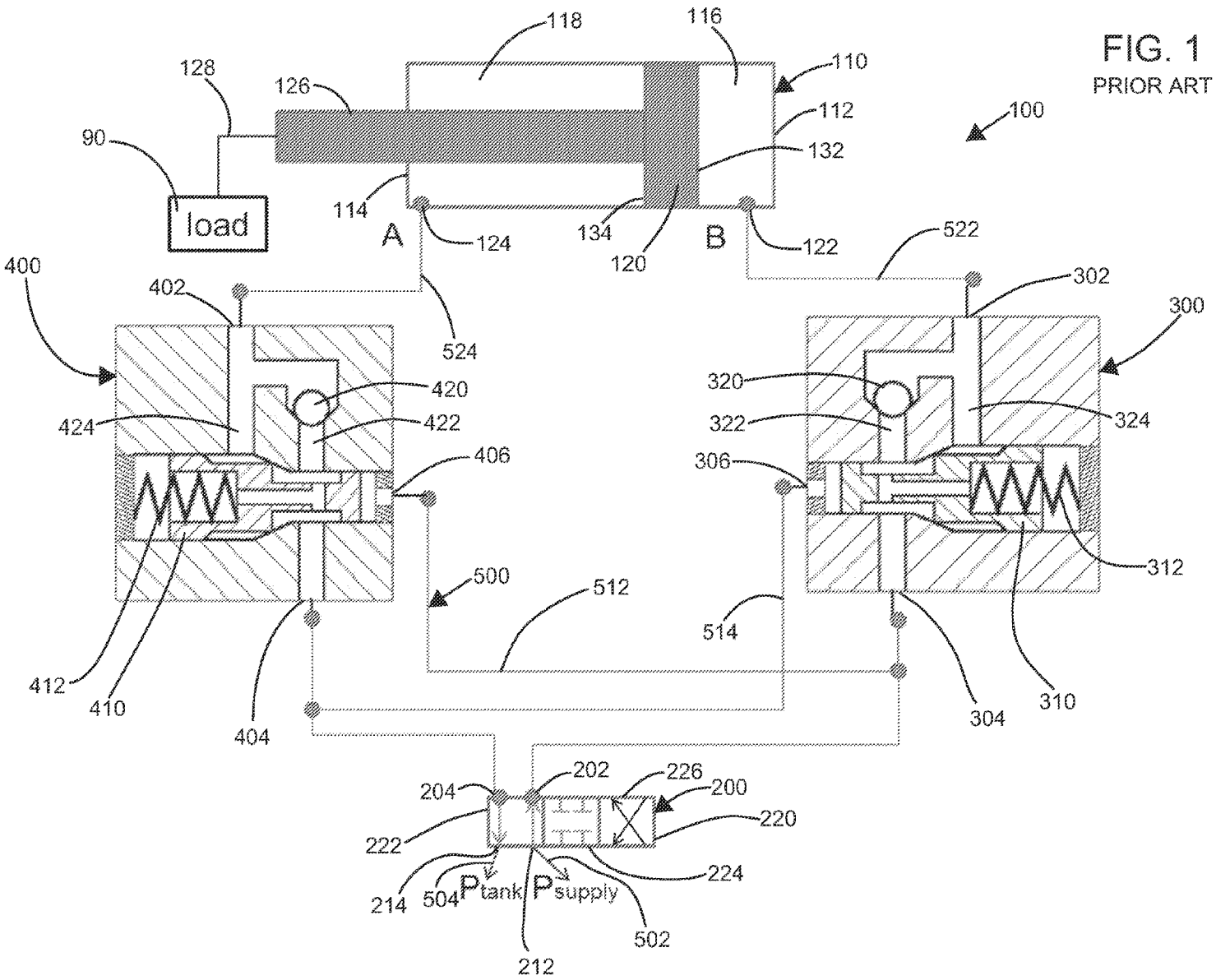
FIG. 1 PRIOR ART
FIG. 1 is a schematic illustration of a prior art hydraulic system including a hydraulic cylinder with a pair of counter-balance valves and a control valve.
Figure 2:
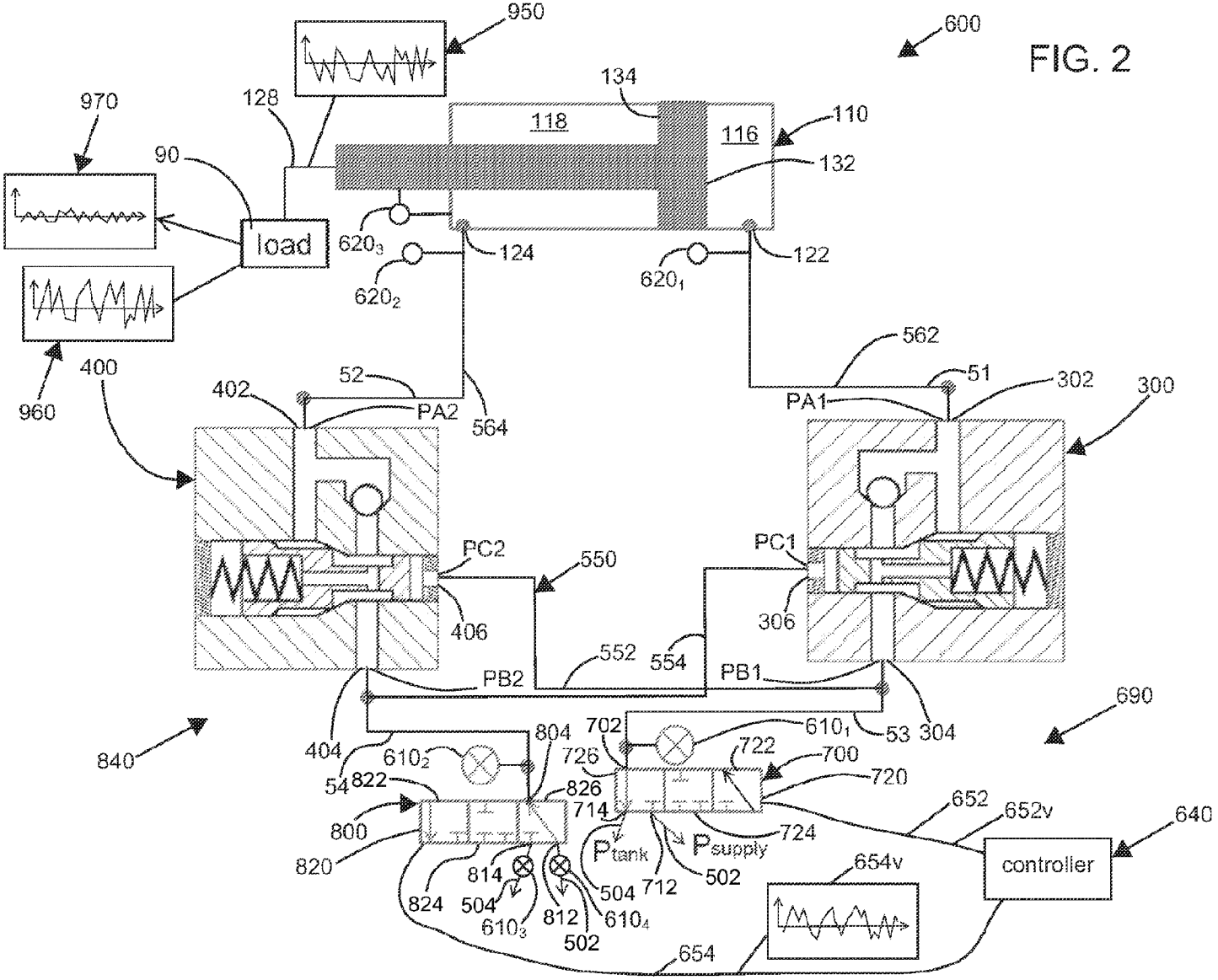
FIG. 2 is a schematic illustration of a hydraulic system including the hydraulic cylinder and the counter-balance valves of FIG. 1 configured with a hydraulic cylinder control system according to the principles of the present disclosure.

According to the principles of the present disclosure, a hydraulic system is adapted to actuate the hydraulic cylinder 110, including the counter-balance valves 300 and 400, and further provide means for counteracting vibrations to which the hydraulic cylinder 110 is exposed. As illustrated at FIG. 2, an example system 600 is illustrated with the hydraulic cylinder 110 (i.e., a hydraulic actuator), the counter-balance valve 300, and the counter-balance valve 400. The hydraulic cylinder 110 and the counter-balance valves 300, 400 of FIG. 2 may be the same as those shown in the prior art system 100 of FIG. 1. The hydraulic system 600 may therefore be retrofitted to an existing and/or a conventional hydraulic system. The depicted embodiment illustrated at FIG. 2 can represent the prior art hydraulic system 100 of FIG. 1 retrofitted by replacing the hydraulic control valve 200 with a valve assembly 690, described in detail below, with little or no plumbing modifications. Other than the hydraulic control valve 200, hydraulic hardware may be left in-place. Certain features of the hydraulic cylinder 110 and the counter-balance valves 300, 400 may be the same or similar between the hydraulic system 600 and the prior art hydraulic system 100. These same or similar components and/or features will not, in general, be redundantly re-described.

According to the principles of the present disclosure, similar protection is provided by the counter-balance valves 300, 400 for the hydraulic cylinder 110 and the hydraulic system 600, as described above with respect to the hydraulic system 100. In particular, failure of a hydraulic line, a hydraulic valve, and/or a hydraulic pump will not lead to an uncommanded movement of the hydraulic cylinder 110 of the hydraulic system 600. The hydraulic architecture of the hydraulic system 600 further provides the ability to counteract vibrations using the hydraulic cylinder 110.

The hydraulic cylinder 110 may hold a net load 90 that, in general, may urge retraction or extension of a rod 126 of the cylinder 110. The rod 126 is connected to the piston 120 of the cylinder 110. If the load 90 urges extension of the hydraulic cylinder 110, the chamber 118 on a rod side 114 of the hydraulic cylinder 110 is pressurized by the load 90, and the counter-balance valve 400 acts to prevent the release of hydraulic fluid from the chamber 118 and thereby acts as a safety device to prevent uncommanded extension of the hydraulic cylinder 110. In other words, the counter-balance valve 400 locks the chamber 118. In addition to providing safety, the locking of the chamber 118 prevents drifting of the cylinder 110. Vibration control may be provided via the hydraulic cylinder 110 by dynamically pressurizing and depressurizing the chamber 116 on a head side 112 of the hydraulic cylinder 110. As the hydraulic cylinder 110, the structure to which the hydraulic cylinder 110 is attached, and the hydraulic fluid within the chamber 118 are at least slightly deformable, selective application of hydraulic pressure to the chamber 116 will cause movement (e.g., slight movement) of the hydraulic cylinder 110. Such movement, when timed in conjunction with a system model and dynamic measurements of the system, may be used to counteract vibrations of the system 600.

If the load 90 urges retraction of the hydraulic cylinder 110, the chamber 116 on the head side 112 of the hydraulic cylinder 110 is pressurized by the load 90, and the counter-balance valve 300 acts to prevent the release of hydraulic fluid from the chamber 116 and thereby acts as a safety device to prevent uncommanded retraction of the hydraulic cylinder 110. In other words, the counter-balance valve 300 locks the chamber 116. In addition to providing safety, the locking of the chamber 116 prevents drifting of the cylinder 110. Vibration control may be provided via the hydraulic cylinder 110 by dynamically pressurizing and depressurizing the chamber 118 on the rod side 114 of the hydraulic cylinder 110. As the hydraulic cylinder 110, the structure to which the hydraulic cylinder 110 is attached, and the hydraulic fluid within the chamber 116 are at least slightly deformable, selective application of hydraulic pressure to the chamber 118 will cause movement (e.g., slight movement) of the hydraulic cylinder 110. Such movement, when timed in conjunction with the system model and dynamic measurements of the system, may be used to counteract vibrations of the system 600.

The load 90 is depicted as attached via a rod connection 128 to the rod 126 of the cylinder 110. In certain embodiments, the load 90 is a tensile or a compressive load across the rod connection 128 and the head side 112 of the cylinder 110.

As is further described below, the system 600 provides a control framework and a control mechanism to achieve boom vibration reduction for both off-highway vehicles and on-highway vehicles. The vibration reduction may be adapted to reduced vibrations in booms with relatively low natural frequencies (e.g., the concrete pump truck boom). The hydraulic system 600 may also be applied to booms with relatively high natural frequencies (e.g., an excavator boom). Compared with conventional solutions, the hydraulic system 600 achieves vibration reduction of booms with fewer sensors and a simplified control structure. The vibration reduction method may be implemented while assuring protection from failures of certain hydraulic lines, hydraulic valves, and/or hydraulic pumps, as described above. The protection from failure may be automatic and/or mechanical. In certain embodiments, the protection from failure may not require any electrical signal and/or electrical power to engage. The protection from failure may be a regulatory requirement (e.g., an ISO standard). The regulatory requirement may require certain mechanical means of protection that is provided by the hydraulic system 600.

Certain booms may include stiffness and inertial properties that can transmit and/or amplify dynamic behavior of the load 90. As the dynamic load 90 may include external force/position disturbances that are applied to the boom, severe vibrations (i.e., oscillations) may result, especially when these disturbances are near the natural frequency of the boom. Such excitation of the boom by the load 90 may result in safety issues and/or decrease productivity and/or reliability of the boom system. By measuring parameters of the hydraulic system 600 and responding appropriately, effects of the disturbances may be reduced and/or minimized or even eliminated. The response provided may be effective over a wide variety of operating conditions. According to the principles of the present disclosure, vibration control may be achieved using minimal numbers of sensors.

According to the principles of the present disclosure, hydraulic fluid flow to the chamber 116 of the head 112 side of the cylinder 110, and hydraulic fluid flow to the chamber 118 of the rod side 114 of the cylinder 110 are independently controlled and/or metered to realize boom vibration reduction and also to prevent the cylinder 110 from drifting. According to the principles of the present disclosure, the hydraulic system 600 may be configured similar to a conventional counter-balance system (e.g., the hydraulic system 100).

In certain embodiments, the hydraulic system 600 is configured to the conventional counter-balance configuration when a movement of the cylinder 110 is commanded. As further described below, the hydraulic system 600 enables measurement of pressures within the chambers 116 and/or 118 of the cylinder 110 at a remote location away from the hydraulic cylinder 110 (e.g., at sensors 610). This architecture thereby may reduce mass that would otherwise be positioned on the boom and/or may simplify routing of hydraulic lines (e.g., hard tubing and hoses). Performance of machines such as concrete pump booms and/or lift handlers may be improved by such simplified hydraulic line routing and/or reduced mass on the boom.

The counter-balance valves 300 and 400 may be components of a valve arrangement 840. The valve arrangement 840 may include various hydraulic components that control and/or regulate hydraulic fluid flow to and/or from the hydraulic cylinder 110. The valve arrangement 840 may further include a control valve 700 (e.g., a proportional hydraulic valve) and a control valve 800 (e.g., a proportional hydraulic valve). The control valves 700 and/or 800 may be high bandwidth and/or high resolution control valves.

In the depicted embodiment of FIG. 2, a node 51 is defined at the port 302 of the counter-balance valve 300 and the port 122 of the hydraulic cylinder 110; a node 52 is defined at the port 402 of the counter-balance valve 400 and the port 124 of the hydraulic cylinder 110; a node 53 is defined at the port 304 of the counter-balance valve 300, the port 406 of the counter-balance valve 400, and the port 702 of the hydraulic valve 700; and a node 54 is defined at the port 404 of the counter-balance valve 400, at the port 306 of the counter-balance valve 300, and the port 804 of the hydraulic valve 800.

Figure 4:
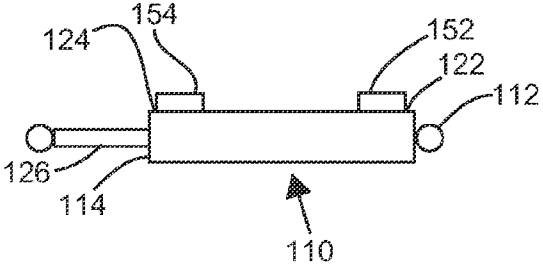
FIG. 4 is a schematic illustration of a hydraulic cylinder suitable for use with the hydraulic cylinder control system of FIG. 2 according to the principles of the present disclosure.

Turning now to FIG. 4, the hydraulic cylinder 110 is illustrated with valve blocks 152, 154. The valve blocks 152, 154 may be separate from each other, as illustrated, or may be a single combined valve block. The valve block 152 may be mounted to and/or over the port 122 of the hydraulic cylinder 110, and the valve block 154 may be mounted to and/or over the port 124 of the hydraulic cylinder 110. The valve blocks 152, 154 may be directly mounted to the hydraulic cylinder 110. The valve block 152 may include the counter-balance valve 300, and the valve block 154 may include the counter-balance valve 400. The valve blocks 152 and/or 154 may include additional components of the valve arrangement 840. The valve blocks 152, 154, and/or the single combined valve block may include sensors (e.g., pressure and/or flow sensors).

Figure 5:
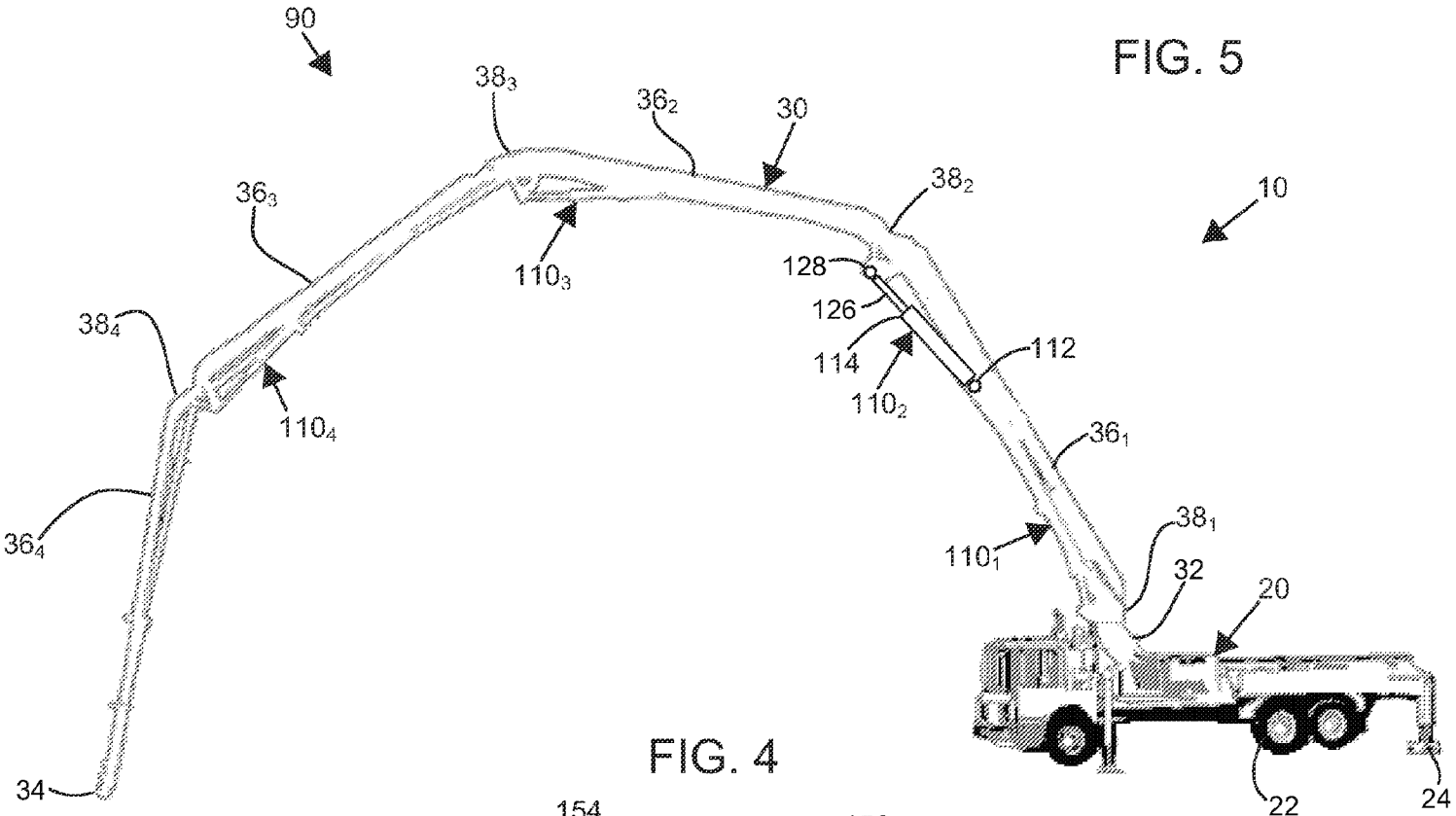
FIG. 5 is a schematic illustration of a vehicle with a boom system that is actuated by one or more cylinders and controlled with the hydraulic system of FIG. 2 according to the principles of the present disclosure.

Turning now to FIG. 5, an example boom system 10 is described and illustrated in detail. The boom system 10 may include a vehicle 20 and a boom 30. The vehicle 20 may include a drive train 22 (e.g., including wheels and/or tracks). As depicted at FIG. 5, rigid retractable supports 24 are further provided on the vehicle 20. The rigid supports 24 may include feet that are extended to contact the ground and thereby support and/or stabilize the vehicle 20 by bypassing ground support away from the drive train 22 and/or suspension of the vehicle 20. In other vehicles (e.g., vehicles with tracks, vehicles with no suspension), the drive train 22 may be sufficiently rigid and retractable rigid supports 24 may not be needed and/or provided.

As depicted at FIG. 5, the boom 30 extends from a first end 32 to a second end 34. As depicted, the first end 32 is rotatably attached (e.g., by a turntable) to the vehicle 20. The second end 34 may be positioned by actuation of the boom 30 and thereby be positioned as desired. In certain applications, it may be desired to extend the second end 34 a substantial distance away from the vehicle 20 in a primarily horizontal direction. In other embodiments, it may be desired to position the second end 34 vertically above the vehicle 20 a substantial distance. In still other applications, the second end 34 of the boom 30 may be spaced both vertically and horizontally from the vehicle 20. In certain applications, the second end 34 of the boom 30 may be lowered into a hole and thereby be positioned at an elevation below the vehicle 20.

As depicted, the boom 30 includes a plurality of boom segments 36. Adjacent pairs of the boom segments 36 may be connected to each other by a corresponding joint 38. As depicted, a first boom segment $\mathbf{36}_1$ is rotatably attached to the vehicle 20 at a first joint $\mathbf{38}_1$. The first boom segment $\mathbf{36}_1$ may be mounted by two rotatable joints. For example, the first rotatable joint may include a turntable, and the second rotatable joint may include a horizontal axis. A second boom segment $\mathbf{36}_2$ is attached to the first boom segment $\mathbf{36}_1$ at a second joint $\mathbf{38}_2$. Likewise, a third boom segment $\mathbf{36}_3$ is attached to the second boom segment $\mathbf{36}_2$ at a joint $\mathbf{38}_3$, and a fourth boom segment $\mathbf{36}_4$ is attached to the third boom segment $\mathbf{36}_3$ at a fourth joint $\mathbf{38}_4$. A relative position/orientation between the adjacent pairs of the boom segments 36 may be controlled by a corresponding hydraulic cylinder 110. For example, a relative position/orientation between the first boom segment $\mathbf{36}_1$ and the vehicle 20 is controlled by a first hydraulic cylinder $\mathbf{110}_1$. The relative position/orientation between the first boom segment $\mathbf{36}_1$ and the second boom segment $\mathbf{36}_2$ is controlled by a second hydraulic cylinder $\mathbf{110}_2$. Likewise, the relative position/orientation between the third boom segment $36_3$ and the second boom segment $36_2$ may be controlled by a third hydraulic cylinder $110_3$, and the relative position/orientation between the fourth boom segment $36_4$ and the third boom segment $36_3$ may be controlled by a fourth hydraulic cylinder $110_4$.

According to the principles of the present disclosure, the boom 30, including the plurality of boom segments $36_{1-4}$, may be modeled and vibration of the boom 30 may be controlled by a controller 640. In particular, the controller 640 may send a signal 652 to the valve 700 and a signal 654 to the valve 800. The signal 652 may include a vibration component 652*v*, and the signal 654 may include a vibration component 654*v*. The vibration component 652*v*, 654*v* may cause the respective valve 700, 800 to produce a vibratory flow and/or a vibratory pressure at the respective port 702, 804. The vibratory flow and/or the vibratory pressure may be transferred through the respective counter-balance valve 300, 400 and to the respective chamber 116, 118 of the hydraulic cylinder 110.

The signals 652, 654 of the controller 640 may also include move signals that cause the hydraulic cylinder 110 to extend and retract, respectively, and thereby actuate the boom 30. As will be further described below, the signals 652, 654 of the controller 640 may also include selection signals that select one of the counter-balance valves 300, 400 as a holding counter-balance valve and select the other of the counter-balance valves 400, 300 as a vibration flow/pressure transferring counter-balance valve. In the depicted embodiment, a loaded one of the chambers 116, 118 of the hydraulic cylinder 110, that is loaded by the net load 90, corresponds to the holding counter-balance valve 300, 400, and an unloaded one of the chambers 118, 116 of the hydraulic cylinder 110, that is not loaded by the net load 90, corresponds to the vibration flow/pressure transferring counter-balance valve 400, 300. In certain embodiments, the vibration component 652*v* or 654*v* may be transmitted to the control valve 800, 700 that corresponds to the unloaded one of the chambers 118, 116 of the hydraulic cylinder 110.

The controller 640 may receive input from various sensors, including the sensors 610, optional remote sensors 620, position sensors, LVDTs, vision base sensors, etc. and thereby compute the signals 652, 654, including the vibration component 652*v*, 654*v* and the selection signals. The controller 640 may include a dynamic model of the boom 30 and use the dynamic model and the input from the various sensors to calculate the signals 652, 654, including the vibration component 652*v*, 654*v* and the selection signals. In certain embodiments, the selection signals include testing signals to determine the loaded one and/or the unloaded one of the chambers 116, 118 of the hydraulic cylinder 110.

In certain embodiments, a single system such as the hydraulic system 600 may be used on one of the hydraulic cylinders 110 (e.g., the hydraulic cylinder 1100. In other embodiments, a plurality of the hydraulic cylinders 110 may each be actuated by a corresponding hydraulic system 600. In still other embodiments, all of the hydraulic cylinders 110 may each be actuated by a system such as the system 600.

Turning now to FIG. 2, certain elements of the hydraulic system 600 will be described in detail. The example hydraulic system 600 includes the proportional hydraulic control valve 700 and the proportional hydraulic control valve 800. In the depicted embodiment, the hydraulic valves 700 and 800 are three-way three position proportional valves. The valves 700 and 800 may be combined within a common valve body. In certain embodiments, some or all of the valves 300, 400, 700, and/or 800 of the hydraulic system 600 may be combined within a common valve body and/or a common valve block. In certain embodiments, some or all of the valves 300, 400, 700, and/or 800 of the valve arrangement 840 may be combined within a common valve body and/or a common valve block. In certain embodiments, both of the valves 300 and 700 of the valve arrangement 840 may be combined within a common valve body and/or a common valve block. In certain embodiments, both of the valves 400 and 800 of the valve arrangement 840 may be combined within a common valve body and/or a common valve block.

The hydraulic valve 700 includes a spool 720 with a first configuration 722, a second configuration 724, and a third configuration 726. As illustrated, the spool 720 is at the third configuration 726. The valve 700 includes a port 702, a port 712, and a port 714. In the first configuration 722, the port 714 is blocked off, and the port 702 is fluidly connected to the port 712. In the second configuration 724, the ports 702, 712, 714 are all blocked off. In the third configuration 726, the port 702 is fluidly connected to the port 714, and the port 712 is blocked off.

The hydraulic valve 800 includes a spool 820 with a first configuration 822, a second configuration 824, and a third configuration 826. As illustrated, the spool 820 is at the third configuration 826. The valve 800 includes a port 804, a port 812, and a port 814. In the first configuration 822, the port 812 is blocked off, and the port 804 is fluidly connected to the port 814. In the second configuration 824, the ports 804, 812, 814 are all blocked off. In the third configuration 826, the port 804 is fluidly connected to the port 812, and the port 814 is blocked off.

In the depicted embodiment, a hydraulic line 562 connects the port 302 of the counter-balance valve 300 with the port 122 of the hydraulic cylinder 110. Node 51 may include the hydraulic line 562. A hydraulic line 564 may connect the port 402 of the counter-balance valve 400 with the port 124 of the hydraulic cylinder 110. Node 52 may include the hydraulic line 564. In certain embodiments, the hydraulic lines 562 and/or 564 are included in valve blocks, housings, etc. and may be short in length. A hydraulic line 552 may connect the port 304 of the counter-balance valve 300 with the port 702 of the hydraulic valve 700 and with the port 406 of the counter-balance valve 400. Node 53 may include the hydraulic line 552. Likewise, a hydraulic line 554 may connect the port 404 of the counter-balance valve 400 with the port 804 of the valve 800 and with the port 306 of the counter-balance valve 300. Node 54 may include the hydraulic line 554.

Sensors that measure temperature and/or pressure at various ports of the valves 700, 800 may be provided. In particular, a sensor $610_1$ is provided adjacent the port 702 of the valve 700. As depicted, the sensor $610_1$ is a pressure sensor and may be used to provide dynamic information about the system 600 and/or the boom system 10. As depicted at FIG. 2, a second sensor $610_2$ is provided adjacent the port 804 of the hydraulic valve 800. The sensor $610_2$ may be a pressure sensor and may be used to provide dynamic information about the hydraulic system 600 and/or the boom system 10. As further depicted at FIG. 2, a third sensor $610_3$ may be provided adjacent the port 814 of the valve 800, and a fourth sensor $610_4$ may be provided adjacent the port 812 of the valve 800.

In certain embodiments, pressure within the supply line 502 and/or pressure within the tank line 504 are well known, and the pressure sensors $610_1$ and $610_2$ may be used to calculate flow rates through the valves 700 and 800, respectively. In other embodiments, a pressure difference across the valve 700, 800 is calculated. For example, the pressure sensor $610_3$ and the pressure sensor $610_2$ may be used when the spool 820 of the valve 800 is at the first position 822 and thereby calculate flow through the valve 800. Likewise, a pressure difference may be calculated between the sensor $610_2$ and the sensor $610_4$ when the spool 820 of the valve 800 is at the third configuration 826. The controller 640 may use these pressures and pressure differences as control inputs.

Temperature sensors may further be provided at and around the valves 700, 800 and thereby refine the flow measurements by allowing calculation of the viscosity and/or density of the hydraulic fluid flowing through the valves 700, 800. The controller 640 may use these temperatures as control inputs.

Although depicted with the first sensor $610_1$, the second sensor $610_2$, the third sensor $610_3$, and the fourth sensor $610_4$, fewer sensors or more sensors than those illustrated may be used in alternative embodiments. Further, such sensors may be positioned at various other locations in other embodiments. In certain embodiments, the sensors 610 may be positioned within a common valve body. In certain embodiments, an Ultronics® servo valve available from Eaton Corporation may be used. The Ultronics® servo valve provides a compact and high performance valve package that includes two three-way valves (i.e., the valves 700 and 800), the pressure sensors 610, and a pressure regulation controller (e.g., included in the controller 640). The Ultronics® servo valve may serve as the valve assembly 690. The Eaton Ultronics® servo valve further includes linear variable differential transformers (LVDT) that monitor positions of the spools 720, 820, respectively. By using the two three-way proportional valves 700, 800, the pressures of the chambers 116 and 118 may be independently controlled. In addition, the flow rates into and/or out of the chambers 116 and 118 may be independently controlled. In other embodiments, the pressure of one of the chambers 116, 118 may be independently controlled with respect to a flow rate into and/or out of the opposite chambers 116, 118.

In comparison with using a single four-way proportional valve 200 (see FIG. 1), the configuration of the hydraulic system 600 can achieve and accommodate more flexible control strategies with less energy consumption. For example, when the cylinder 110 is moving, the valve 700, 800 connected with the metered-out chamber 116, 118 can manipulate the chamber pressure while the valves 800, 700 connected with the metered-in chamber can regulate the flow entering the chamber 118, 116. As the metered-out chamber pressure is not coupled with the metered-in chamber flow, the metered-out chamber pressure can be regulated to be low and thereby reduce associated throttling losses.

The supply line 502, the return line 504, the hydraulic line 552, the hydraulic line 554, the hydraulic line 562, and/or the hydraulic line 564 may belong to a line set 550.

Upon vibration control being deactivated (e.g., by an operator input), the hydraulic system 600 may configure the valve arrangement 840 as a conventional counter-balance/control valve arrangement. The conventional counter-balance/control valve arrangement may be engaged when moving the boom 30 under move commands to the control valves 700, 800.

Upon vibration control being activated (e.g., by an operator input), the valve arrangement 840 may effectively lock the hydraulic cylinder 110 from moving. In particular, the activated configuration of the valve arrangement 840 may lock one of the chambers 116, 118 of the hydraulic cylinder 110 while sending vibratory pressure and/or flow to an opposite one of the chambers 118, 116. The vibratory pressure and/or flow may be used to counteract external vibrations encountered by the boom 30.

Figure 3:
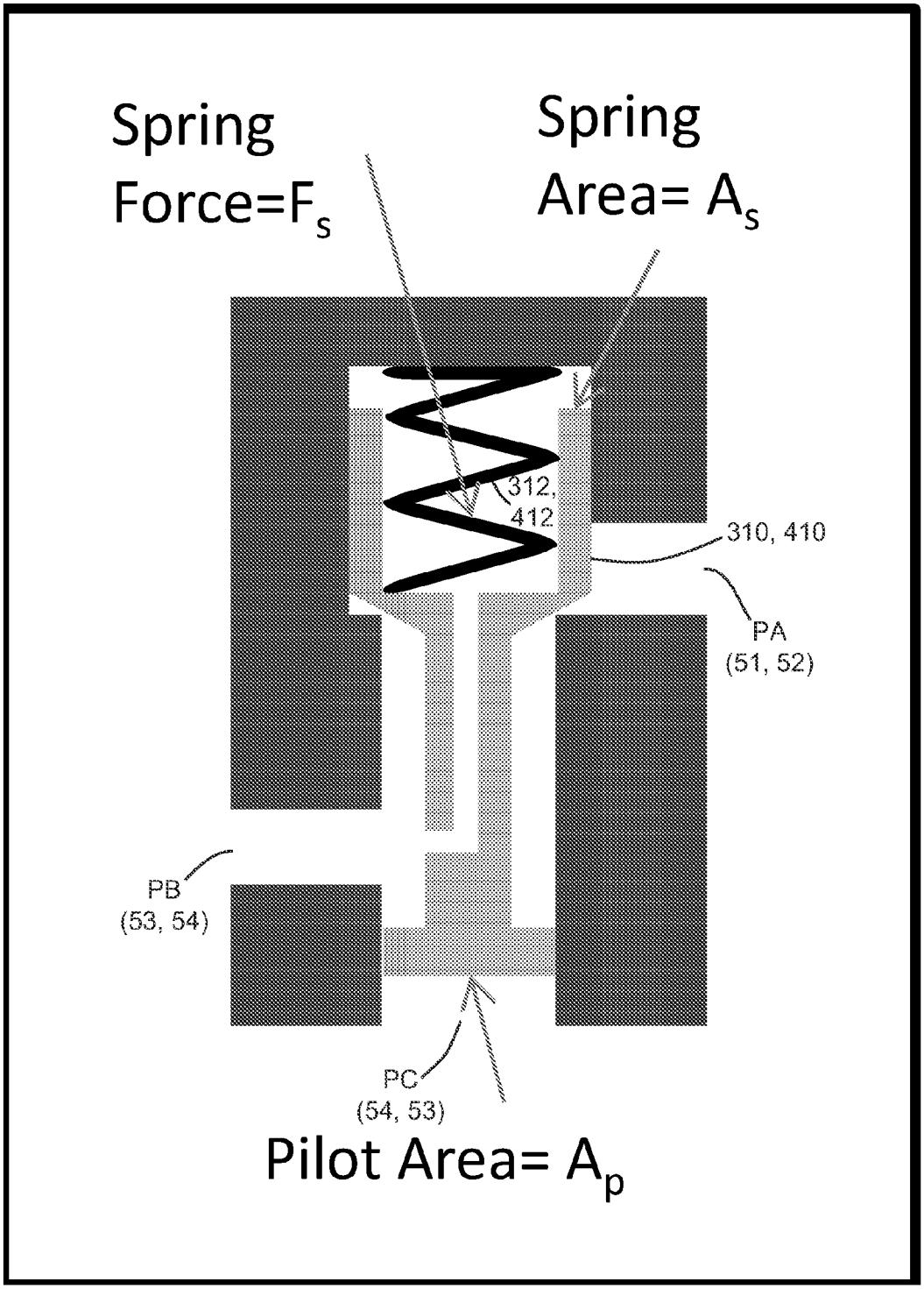
FIG. 3 is an enlarged schematic illustration of counter-balance valve components that are suitable for use with the counter-balance valves of FIGS. 1 and 2.

Turning now to FIG. 3, certain components of the counter-balance valve 300, 400 will be described in detail. The counter-balance valve 300, 400 includes a first port PA, a second port PB, and a third port PC. As depicted, the port PA is fluidly connected to a hydraulic component (e.g., the hydraulic cylinder 110). The port PB is fluidly connected to a control valve (e.g., the control valve 700, 800). The port PC is a pilot port that is fluidly connected to the port PB of an opposite counter-balance valve. By connecting the port PC to the port PB of the opposite counter-balance valve, the port PC is also fluidly connected to a control valve 800, 700 that is opposite the control valve connected to the port PB.

The ports PA, PB, PC, as illustrated at FIG. 3, relate to the ports 302, 304, 306, 402, 404, 406 of the counter-balance valves 300, 400 as follows. The port PA corresponds to the port 302 of the counter-balance valve 300. The port 302 is further labeled PA1 at FIG. 2 and corresponds with the node 51. The port PB corresponds with the port 304 of the counter-balance valve 300. The port 304 is further labeled PB1 and corresponds with the node 53. The port PC corresponds with the port 306 of the counter-balance valve 300. The port 306 is further labeled port PC1 and corresponds with the node 54. The port PA also corresponds to the port 402 of the counter-balance valve 400. The port 402 is further labeled PA2 at FIG. 2 and corresponds with the node 52. The port PB also corresponds with the port 404 of the counter-balance valve 400. The port 404 is further labeled PB2 and corresponds with the node 54. The port PC also corresponds with the port 406 of the counter-balance valve 400. The port 406 is further labeled port PC2 and corresponds with the node 53.

The spool 310, 410 is movable within a bore of the counter-balance valve 300, 400. In particular, a net force on the spool 310, 410 moves or urges the spool 310, 410 to move within the bore. The spool 310, 410 includes a spring area $A_S$ and an opposite pilot area $A_P$. The spring area $A_S$ is operated on by a pressure at the port PB. Likewise, the pilot area $A_P$ is operated on by a pressure at the port PC. As depicted at FIG. 3, in certain embodiments, a pressure at the port PA may have negligible or minor effects on applying a force that urges movement on the spool 310, 410. In other embodiments, as depicted at FIGS. 1 and 2, the spool 310, 410 may further include features that adapt the counter-balance valve 300, 400 to provide a relief valve function responsive to a pressure at the port PA1, PA2. In addition to forces generated by fluid pressure acting on the areas $A_S$ and $A_P$, the spool 310, 410 is further operated on by a spring force $F_S$. In the absence of pressure at the ports PB and PC, the spring force $F_S$ urges the spool 310, 410 to seat and thereby prevent fluid flow between the ports PA and PB. As illustrated at FIG. 1, a passage 322, 422 and check valves 320, 420 allow fluid to flow from the port 304, 404 to the port 302, 402 by bypassing the seated spool 310, 410. However, flow from the port 302, 402 to the port 304, 404 is prevented by the check valve 320, 420, when the spool 310, 410 is seated.

According to certain embodiments of the present disclosure, the counter-balance valves 300, 400 may be omitted. In these embodiments, an anti-vibration algorithm may be executed by the controller 640 and the control valves 700 and 800, without the counter-balance valves 300, 400. In these embodiments, the port 702 of the control valve 700 is fluidly connected directly to the port 122 of the hydraulic cylinder 110. Likewise, the port 804 of the control valve 800 is directly fluidly connected to the port 124 of the hydraulic cylinder 110. These particular embodiments may be limited in use by safety concerns and/or regulatory requirements that require counter-balance valves. In these embodiments, without counter-balance valves, fluid pressure at the ports 122 and 702 can be directly measured by the sensor $\mathbf{610}_1$ of the control valve 700. Likewise, the pressure at the ports 124, 804 can be directly measured by the sensor $\mathbf{610}_2$ of the control valve 800. A net load direction on the hydraulic cylinder 110 can be determined by comparing the pressure measured by the sensor $\mathbf{610}_1$ multiplied by the effective area of the chamber 116 and comparing with the pressure measured by the sensor $\mathbf{610}_2$ multiplied by the effective area of the chamber 118.

If the net load is supported by the chamber 116, the control valve 700 is kept closed and the control valve 800 may supply a vibration canceling fluid flow to the chamber 118. The sensors $\mathbf{610}_1$ and/or $\mathbf{610}_2$ can be used to detect the frequency, phase, and/or amplitude of any external vibrational inputs to the hydraulic cylinder 110. Alternatively or additionally, vibrational inputs to the hydraulic cylinder 110 may be measured by an upstream pressure sensor, an external position sensor, an external acceleration sensor, and/or various other sensors. If the net load is supported by the chamber 118, the control valve 800 is kept closed and the control valve 700 may supply a vibration canceling fluid flow to the chamber 116. The sensors $\mathbf{610}_1$ and/or $\mathbf{610}_2$ can be used to detect the frequency, phase, and/or amplitude of any external vibrational inputs to the hydraulic cylinder 110. Alternatively or additionally, vibrational inputs to the hydraulic cylinder 110 may be measured by an upstream pressure sensor, an external position sensor, an external acceleration sensor, and/or various other sensors.

In the embodiments with the counter-balance valves 300, 400 omitted and also in other embodiments including the counter-balance valves 300, 400, the vibration cancellation algorithm can take different forms. In certain embodiments, the frequency and phase of the external vibration may be identified by a filtering algorithm (e.g., by Least Mean Squares, Fast Fourier Transform, etc.). In certain embodiments, the frequency, the amplitude, and/or the phase of the external vibration may be identified by various conventional means. In certain embodiments, upon identifying the frequency, the amplitude, and/or the phase of the external vibration, a pressure signal with the same frequency and appropriate phase shift may be applied at the unloaded chamber 116, 118 to cancel out the disturbance caused by the external vibration. The control valves 700 and/or 800 may be used along with the controller 640 to continuously monitor flow through the control valves 700 and/or 800 to ensure no unexpected movements occur (see step 1222 of FIG. 6).

In the depicted embodiments, with the counter-balance valves 300 and 400, the sensors $\mathbf{610}_1$ and $\mathbf{610}_2$ are shielded from measuring the pressures at the ports 122 and 124 of the hydraulic cylinder 110, respectively. Therefore, additional methods can be used to determine the direction of the net load on the cylinder 110 and to determine external vibrations acting on the cylinder 110. In certain embodiments, pressure sensors (e.g., pressure sensors $\mathbf{610}_1$ and $\mathbf{610}_2$) at the ports 122 and/or 124 may be used. In other embodiments, the pressure sensors $\mathbf{610}_1$ and $\mathbf{610}_2$ may be used. Alternatively or additionally, other sensors such as accelerometers, position sensors, visual tracking of the boom 30, etc. may be used (e.g., a position, velocity, and/or acceleration sensor $\mathbf{610}_3$ that tracks movement of the rod 126 of the hydraulic cylinder 110).

In embodiments where the sensors $\mathbf{610}_1$ and/or $\mathbf{610}_2$ are not used to determine the direction of the cylinder load or the external vibration characteristics, the valve arrangement 840 may be configured to apply an anti-vibration (i.e., a vibration cancelling) response as follows. If the net load is determined to be held by the chamber 116, the control valve 700 pressurizes node 53 thereby opening the counter-balance valve 400 and further urging the counter-balance valve 300 to close. Upon the counter-balance valve 400 being opened, the control valve 800 may apply an anti-vibration fluid pressure/flow to the chamber 118. The controller 640 may calculate a maximum permissible pressure that can be delivered by the control valve 800 to preclude opening the counter-balance valve 300. If the net load is determined to be held by the chamber 118, the control valve 800 pressurizes node 54 thereby opening the counter-balance valve 300 and further urging the counter-balance valve 400 to close. Upon the counter-balance valve 300 being opened, the control valve 700 may apply an anti-vibration fluid pressure/flow to the chamber 116. The controller 640 may calculate a maximum permissible pressure that can be delivered by the control valve 700 to preclude opening the counter-balance valve 400.

In embodiments where the direction of the net cylinder load is independently known to be acting on the chamber 116 but at least some of the parameters of the external vibration acting on the hydraulic cylinder 110 are unknown from external sensor information, the pressure sensor $\mathbf{610}_2$ may be used to measure pressure fluctuations within the chamber 118 and thereby determine characteristics of the external vibration. If the direction of the net cylinder load is independently known to be acting on the chamber 118 but at least some of the parameters of the external vibration acting on the hydraulic cylinder 110 are unknown from external sensor information, the pressure sensor $\mathbf{610}_1$ may be used to measure pressure fluctuations within the chamber 116 and thereby determine characteristics of the external vibration.

Figure 6:
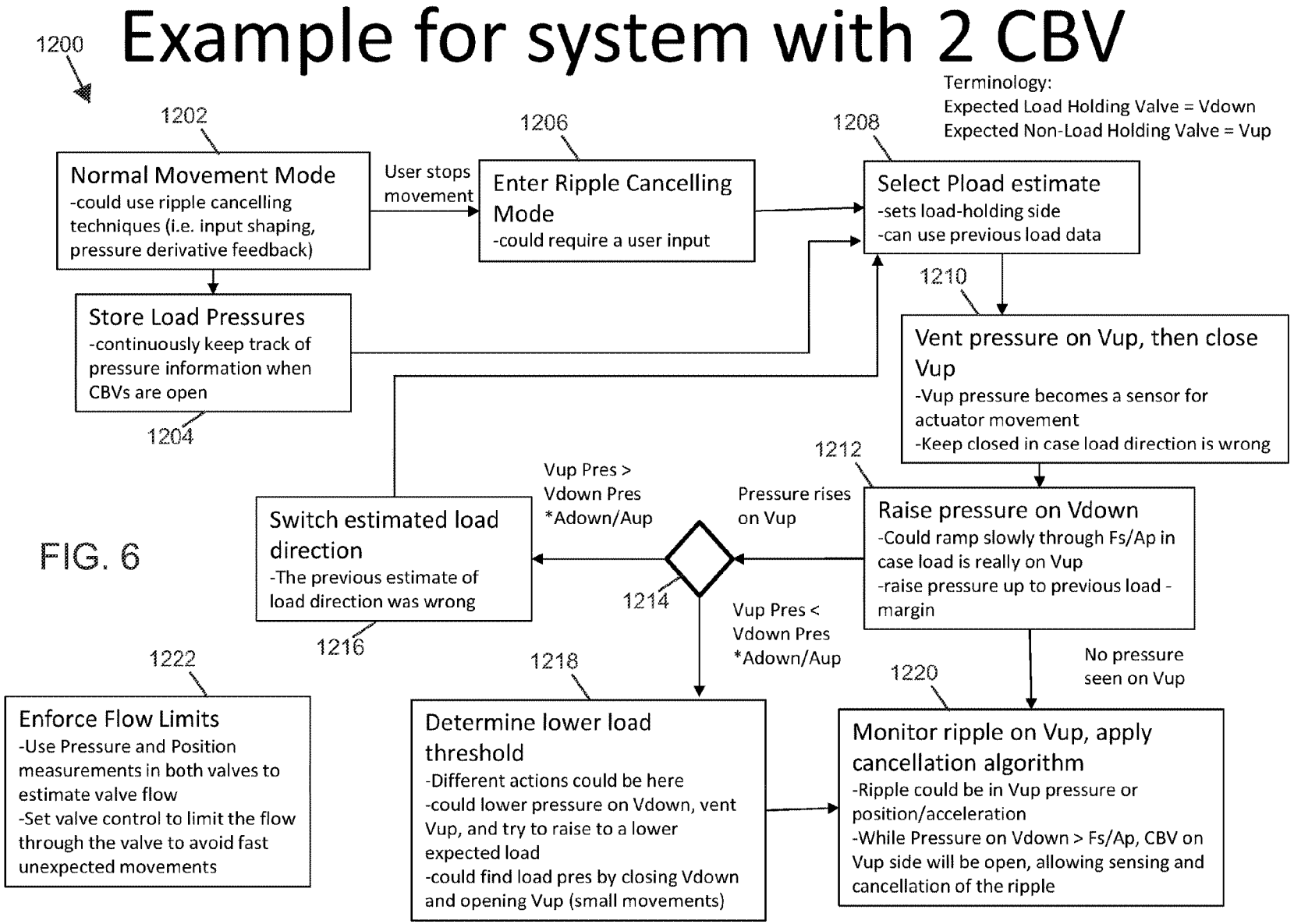
FIG. 6 is a flow chart illustrating an example method for controlling a cylinder used to position a boom, such as the hydraulic cylinder of FIG. 4, according to the principles of the present disclosure.

As illustrated at FIG. 6, in embodiments where neither the direction of the load acting on the hydraulic cylinder 110 nor the vibrational characteristics of the external vibration are known, additional methods of flow chart 1200 may be employed to determine the direction and/or the magnitude of the net load acting on the hydraulic cylinder 110. In particular, load information may be stored whenever the boom 30 is moved. Step 1202 depicts normal movement of the boom 30 by the hydraulic cylinder 110. When the boom 30 is moved by the hydraulic cylinder 110, pressures applied to the ports 122, 124 may be measured by the sensors $\mathbf{610}_1$, $\mathbf{610}_2$ and the net load information may be calculated by the controller 640. In certain embodiments, the controller 640 may calculate and/or estimate certain pressure drops across the valve arrangement 840 and/or the line set 550 when calculating the net load direction and/or the net load magnitude on the hydraulic cylinder 110. This information may be stored as last known information at step 1204.

Upon entering a vibration cancelling mode at step 1206, the last known load direction and/or magnitude information may be used as a first educated guess of the current net load direction and/or magnitude at step 1208. To verify that the stored net load direction and/or magnitude represents a current state of the net load direction and/or magnitude, the control valves 700, 800 may be used to test the hydraulic cylinder 110 with the counter-balance valves 300, 400 continuing to provide protection to the hydraulic cylinder 110.

In particular, with the net load assumed to be supported by the chamber 116, the control valve 800 may initially vent node 54 to tank, as illustrated at step 1210. Upon venting node 54, control valve 800 is kept closed to prevent movement of the cylinder 110, in the case that the assumed load direction is incorrect. Upon the control valve 800 being closed, the control valve 700 increases pressure at the node 53 by increasing the pressure as a function of time, as illustrated at step 1212. This increase in pressure could ramp up linearly with time up to a magnitude of the assumed load pressure minus a margin. If no pressure is detected by the sensor $\mathbf{610}_2$ in response to the ramp up of the pressure at node 53, then the assumed load direction was correct and the sensor $\mathbf{610}_2$ may be used to monitor the external vibration on the cylinder 110. When the pressure on node 53 is greater than the spring force $F_S$ divided by the pilot area $A_P$, the counter-balance valve 400 will be open and thereby allow the sensor $\mathbf{610}_2$ to measure the vibrational characteristics of the chamber 118 and furthermore allow the control valve 800 to apply an anti-vibrational fluid flow to the chamber 118 at step 1220.

If the pressure measured by sensor $\mathbf{610}_2$ rises in response to the ramping up of the pressure at node 53, a test is done at step 1214 to see if the pressure at the sensor $\mathbf{610}_2$ is greater than or less than the pressure at node 53 multiplied by the ratios of the effective areas of chamber 116 divided by 118. If this test determines that the pressure at node 54 is greater than the pressure at node 53 multiplied by the effective area ratio, then the assumed load direction was incorrect and this assumption is reversed at step 1216. If the pressure at node 54 is less than the pressure at node 53 multiplied by the effective areas of the chamber 116 divided by the chamber 118, the estimated load magnitude was higher than the actual load magnitude and the load magnitude estimate is lowered and retested at step 1218 to check if correct. In testing to determine if the new lowered load magnitude estimate is correct, node 54 is vented and the pressure at node 53 is again ramped up by the control valve 700, but to a lower value. Alternatively, the load pressure $P_{load}$ could be determined by closing the control valve 700 and opening the control valve 800. By closing the control valve 700 and opening the control valve 800, all pressure is removed from the chamber 118. Thus, the residual pressure that is in node 53 is the load pressure $P_{load}$.

In step 1222, the control valves 700 and/or 800 may be used along with the controller 640 to continuously monitor flow through the control valves 700 and/or 800 to ensure no unexpected movements occurs. The step 1222 can run continuously and/or concurrently with the other steps.

With the net load assumed to be supported by the chamber 118, the control valve 700 may initially vent node 53 to tank, as illustrated at step 1210. Upon venting node 53, control valve 700 is kept closed to prevent movement of the cylinder 110, in the case that the assumed load direction is incorrect. Upon the control valve 700 being closed, the control valve 800 increases pressure at the node 54 by increasing the pressure as a function of time, as illustrated at step 1212. This increase in pressure could ramp up linearly with time up to a magnitude of the assumed load pressure minus a margin. If no pressure is detected by the sensor $\mathbf{610}_1$ in response to the ramp up of the pressure at node 54, then the assumed load direction was correct and the sensor $\mathbf{610}_1$ may be used to monitor the external vibration on the cylinder 110. When the pressure on node 53 is greater than the spring force $F_S$ divided by the pilot area $A_P$, the counter-balance valve 300 will be open and thereby allow the sensor $\mathbf{610}_1$ to measure the vibrational characteristics of the chamber 116 and furthermore allow the control valve 700 to apply an anti-vibrational fluid flow to the chamber 116 at step 1220.

If the pressure measured by sensor $\mathbf{610}_1$ rises in response to the ramping up of the pressure at node 54, a test is done at step 1214 to see if the pressure at the sensor $\mathbf{610}_1$ is greater than or less than the pressure at node 54 multiplied by the ratios of the effective areas of chamber 118 divided by 116. If this test determines that the pressure at node 53 is greater than the pressure at node 54 multiplied by the effective area ratio, then the assumed load direction was incorrect and this assumption is reversed at step 1216. If the pressure at node 53 is less than the pressure at node 54 multiplied by the effective areas of the chamber 118 divided by the chamber 116, the estimated load magnitude was higher than the actual load magnitude and the load magnitude estimate is lowered and retested at step 1218 to check if correct. In testing to determine if the new lowered load magnitude estimate is correct, node 53 is vented and the pressure at node 54 is again ramped up by the control valve 800, but to a lower value. Alternatively, the load pressure $P_{load}$ could be determined by closing the control valve 800 and opening the control valve 700. By closing the control valve 800 and opening the control valve 700, all pressure is removed from the chamber 116. Thus, the residual pressure that is in node 54 is the load pressure $P_{load}$.

As schematically illustrated at FIG. 2, an environmental vibration load 960 is imposed as a component of the net load 90 on the hydraulic cylinder 110. As depicted at FIG. 2, the vibration load component 960 does not include a steady state load component. In certain applications, the vibration load 960 includes dynamic loads such as wind loads, momentum loads of material that may be moved along the boom 30, inertial loads from moving the vehicle 20, and/or other dynamic loads. The steady state load may include gravity loads that may vary depending on the configuration of the boom 30. The vibration load 960 may be sensed and estimated/measured by the various sensors 610 and/or other sensors. The controller 640 may process these inputs and use a model of the dynamic behavior of the boom system 10 and thereby calculate and transmit an appropriate vibration signal **652*v*, 654*v*. The signal 652*v*, 654*v* is transformed into hydraulic pressure and/or hydraulic flow at the corresponding valve 700, 800. The vibratory pressure/flow is transferred through the corresponding counter-balance valve 300, 400 and to the corresponding chamber 116, 118 of the hydraulic cylinder 110. The hydraulic cylinder 110 transforms the vibratory pressure and/or the vibratory flow into a vibratory response force/displacement 950. When the vibratory response 950 and the vibration load 960 are superimposed on the boom 30, a resultant vibration 970 is produced. The resultant vibration 970 may be substantially less than a vibration of the boom 30 generated without the vibratory response 950. Vibration of the boom 30 may thereby be controlled and/or reduced enhancing the performance, durability, safety, usability, etc. of the boom system 10. The vibratory response 950 of the hydraulic cylinder 110 is depicted at FIG. 2 as a dynamic component of the output of the hydraulic cylinder 110. The hydraulic cylinder 110** may also include a steady state component (i.e., a static component) that may reflect static loads such as gravity.

According to the principles of the present disclosure, a control method uses independent metering main control valves 700, 800 with embedded sensors 610 (e.g., embedded pressure sensors) that can sense oscillating pressure and provide a ripple cancelling pressure with counter-balance valves 300, 400 (CBVs) installed. The approach calls for locking one side (e.g., one chamber 116 or 118) of the actuator 110 in place to prevent drifting of the actuator 110. According to the principles of the present disclosure, active ripple cancelling is provided, an efficiency penalty of orifices is avoided, and/or the main control valves 700, 800 are the only control elements. According to the principles of the present disclosure, embedded pressure sensors embedded in the valve 700, 800 and/or external pressure/acceleration/position sensors may be used.

Figure 7:
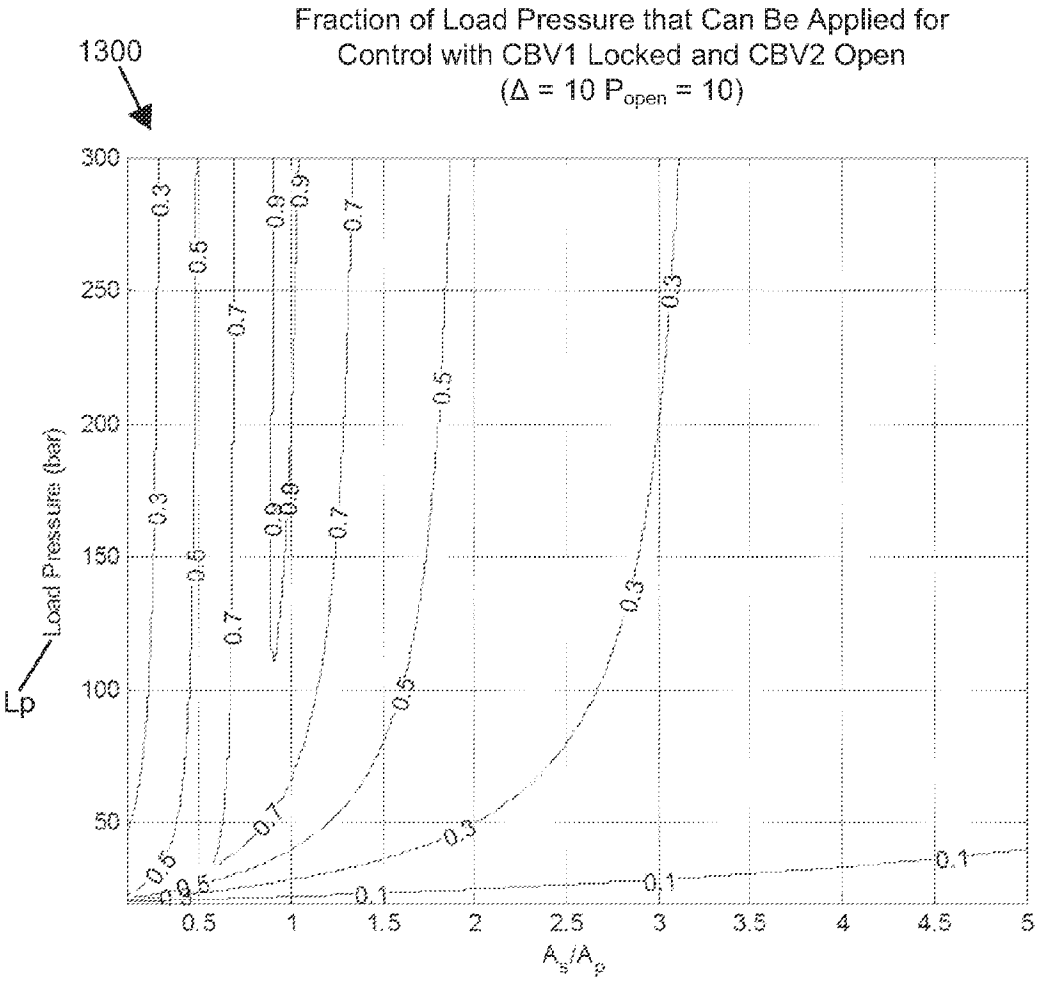
FIG. 7 is a graph illustrating parameter selection for the counter-balance valve components of FIG. 3.

Turning now to FIG. 7, certain design parameters of the counter-balance valves 300, 400 and their interrelationships are illustrated in a graph 1300, according to the principles of the present disclosure. As described above, a first counter-balance valve CBV1 of the counter-balance valves 300, 400 is locked (i.e., closed), and a second counter-balance valve CBV2 of the counter-balance valves 300, 400 is open when active vibration cancellation by the valve arrangement 840 is practiced. In addition, a first control valve CV1 of the control valves 700, 800 applies a holding pressure, and a second control valve CV2 of the control valves 700, 800 applies a fluctuating pressure when active vibration cancellation by the valve arrangement 840 is practiced. The holding pressure is transmitted from the first control valve CV1 to hold the first counter-balance valve CBV1 closed and to hold the second counter-balance valve CBV2 open. The holding pressure is less than a load pressure $P_{load}$ generated at the chamber 116, 118 holding the load 90. The fluctuating pressure is transmitted from the second control valve CV2 through the open second counter-balance valve CBV2 to the chamber 118, 116 not holding the load 90. The fluctuating pressure causes the hydraulic cylinder 110 to produce a vibratory response 950.

In certain embodiments of the present disclosure, practical limits bound a maximum magnitude $P_{control,\ max}$ of the fluctuating pressure. The maximum magnitude $P_{control,\ max}$ may limit the magnitude of the vibratory response 950. As illustrated at FIG. 7, the selection of certain design parameters of the counter-balance valves 300, 400 may, at least in part, determine the maximum magnitude $P_{control,\ max}$. In particular, the spring area $A_S$, the pilot area $A_P$, and the spring force $F_S$ (see FIG. 3), may, at least in part, determine the maximum magnitude $P_{control,\ max}$.

In generating the graph 1300, a closing of the first counter-balance valve CBV1 leads to the condition $$P_{control,max} \times A_P < (P_{load} - \Delta) \times A_S + F_S;$$

and, an opening of the second counter-balance valve CBV2 leads to the condition $$P_{control,max} \times A_S < (P_{load} - \Delta) \times A_P - F_S.$$

Delta Δ is some margin below the load pressure $P_{load}$. An opening pressure $P_S$ of the counter-balance valves CBV1 and CBV2 may be defined as $P_S = F_S/A_P$. The counter-balance valves CBV1 and CBV2 may be idealized as fully open above the opening pressure $P_S$ as a spring rate of the springs 312, 412 may be selected to be a low spring rate, and an overall flow rate through the open second counter-balance valve CBV2 may be relatively small.

As the graph 1300 at FIG. 7 illustrates, the selection of the spring area $A_S$ and the pilot area $A_P$, relative to each other, influences control authority of the maximum magnitude $P_{control,\ max}$ of the fluctuating pressure and thereby influences control authority of the vibratory response 950. Therefore, in certain embodiments, the counter-balance valves CBV1 and CBV2 may be designed with the above in mind. In the example above, the control authority is maximized if a ratio $A_S/A_P$ of the spring area $A_S$ to the pilot area $A_P$ is about 1 or slightly less than 1. Increasing the delta Δ lowers the maximum magnitude $P_{control,\ max}$ of the fluctuating pressure and thereby lowers the control authority of the vibratory response 950. Increasing the opening pressure $P_S$ of the counter-balance valves CBV1 and CBV2 increases curvature seen at the bottom of the graph 1300.

In the above example, the first and the second counter-balance valves CBV1 and CBV2 include the same design parameters. In other embodiments, the first and the second counter-balance valves CBV1 and CBV2 may be different from each other.

This application relates to U.S. Provisional patent application Ser. No. 61/829,796, filed on May 31, 2013, entitled Hydraulic System and Method for Reducing Boom Bounce with Counter-Balance Protection, which is hereby incorporated by reference in its entirety.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A hydraulic system comprising:

a hydraulic cylinder;

a first control valve fluidly connected to the hydraulic cylinder;

a controller in communication with the first control valve, the controller being adapted to transmit move signals to the control valve that causes the hydraulic cylinder to extend and/or retract, and the controller being adapted to transmit a vibration signal to the first control valve to produce a fluctuating pressure that causes the hydraulic cylinder to produce a vibratory response; and a first counter-balance valve fluidly connected to the hydraulic cylinder at a first node, wherein, when vibration control is active, a holding pressure is transmitted from the first control valve to hold the first counter-balance valve at a closed position, and wherein the holding pressure is less than a load pressure at the first node;

wherein when a net load is supported by the hydraulic cylinder, and wherein when vibration control is active, a fluctuating pressure is transmitted from a second control valve, fluidly connected to the hydraulic cylinder, to cause the hydraulic cylinder to produce a vibratory response.

2. The hydraulic system of claim 1, wherein the first control valve is fluidly connected to a first chamber of the hydraulic cylinder and the second control valve is fluidly connected to a second chamber of the hydraulic cylinder.

3. The hydraulic system of claim 2, wherein the first and second control valves are independently operable with respect to each other.

4. The hydraulic system of claim 2 further comprising a second counter-balance valve fluidly connected to the second chamber at a second node.

5. The hydraulic system of claim 2, wherein the second control valve includes a pressure sensor adapted to measure a vibration load applied to the hydraulic cylinder.

6. The hydraulic system of claim 2, wherein the second control valve is fluidly connected to a pilot of the first counter-balance valve, wherein the first counter-balance valve is opened by the second control valve supplying a pressure to the pilot of the first counter-balance valve;

wherein the first control valve is adapted to apply a holding pressure to the first counter-balance valve, and wherein the second control valve is adapted to apply a fluctuating pressure to an actuator.

7. The hydraulic system of claim 6, further comprising a second counter-balance valve providing a second back-flow protection to a second node, wherein the second control valve is adapted to apply a fluctuating pressure through to the second counter-balance valve and thereby generate a fluctuating response from the actuator.

8. The hydraulic system of claim 6, wherein the first control valve is connected to a pilot of the second counter-balance valve.

9. The hydraulic system of claim 8, wherein the first control valve is adapted to apply a holding pressure to the pilot of the second counter-balance valve.

10. The hydraulic system of claim 7, wherein the first counter-balance valve and the second counter-balance valve are physically mounted to the hydraulic cylinder.

11. A method of controlling vibration in a boom, the method comprising:

providing a hydraulic actuator including a pair of chambers including a first chamber and a second chamber;

providing a valve arrangement including a pair of control valves corresponding to the pair of chambers, the pair of control valves including first and second control valves that are independently operable;

identifying a vibratory condition;

transmitting a vibration signal to the first or second control valve to produce a fluctuating pressure that causes the hydraulic cylinder to produce a vibratory response; and identifying the first and second chambers as being one of an unloaded chamber or a loaded chamber;

wherein the transmitting step includes transmitting a vibration signal to the control valve associated with the unloaded chamber.

12. The method of claim 11, further comprising:

locking a counter-balance valve that corresponds to the loaded chamber.

13. The method of claim 11, wherein a control valve of the pair of control valves is directly fluidly connected to a pilot of a counter-balance valve.

14. The method of claim 11, wherein increasing pressure from one of the pair of the control valves provides an input for a test to identify the loaded chamber and wherein a pressure measured by a pressure sensor of another of the pair of the control valves provides an output for the test to identify the loaded chamber.

15. The method of claim 11, wherein the valve arrangement measures a characteristic of the vibration in the boom.

16. The method of claim 11, wherein at least one pressure sensor fluidly connected to at least one port of the hydraulic actuator identifies the loaded chamber of the pair of chambers.

17. The method of claim 11, wherein at least one pressure sensor fluidly connected to at least one port of the hydraulic actuator identifies a characteristic of the vibration in the boom.

* * * * *